US005542669A

United States Patent [19]

Charron et al.

[11] Patent Number: 5,542,669

[45] Date of Patent: Aug. 6, 1996

[54] METHOD AND APPARATUS FOR RANDOMLY INCREASING THE PAYBACK IN A VIDEO GAMING APPARATUS

[75] Inventors: Daniel P. Charron; Daniel F. Yeates, both of Las Vegas, Nev.

[73] Assignee: Universal Distributing of Nevada, Inc., Las Vegas, Nev.

[21] Appl. No.: 311,404

[22] Filed: Sep. 23, 1994

[51] Int. Cl.[6] ..... A63F 9/00

[52] U.S. Cl. ..... 463/13; 463/26

[58] Field of Search ..... 273/85 CP, 138 R, 273/143 R, 292, 138 A

[56] References Cited

U.S. PATENT DOCUMENTS

| | | | |
|---|---|---|---|
| 4,258,838 | 3/1981 | Rockola et al. . | |
| 4,624,459 | 11/1986 | Kaufman . | |
| 4,662,636 | 5/1987 | Crompton . | |
| 4,861,041 | 8/1989 | Jones et al. . | |
| 5,016,880 | 5/1991 | Berge . | |
| 5,048,833 | 9/1991 | Lamle | 273/138 R |
| 5,167,413 | 12/1992 | Fulton . | |
| 5,205,555 | 4/1993 | Hamano | 273/143 R |
| 5,249,800 | 10/1993 | Hilgendorf | 273/85 CP |
| 5,257,179 | 10/1993 | DeMar . | |
| 5,259,616 | 11/1993 | Bergmann . | |
| 5,332,219 | 7/1994 | Marnell, II et al. | 273/85 CP |
| 5,415,404 | 5/1995 | Joshi et al. | 273/85 CP |

FOREIGN PATENT DOCUMENTS

| | | | |
|---|---|---|---|
| 3915655 | 11/1990 | Germany . | |
| 4329978 | 11/1992 | Japan . | |
| 2098779 | 11/1982 | United Kingdom | 273/143 R |
| 2165385 | 4/1986 | United Kingdom . | |
| 2197974 | 6/1988 | United Kingdom | 273/143 R |
| 2201279 | 8/1988 | United Kingdom . | |
| 2211975 | 7/1989 | United Kingdom . | |
| 92/010818 | 6/1992 | WIPO . | |

*Primary Examiner*—Jessica J. Harrison
*Assistant Examiner*—James Schaaf
*Attorney, Agent, or Firm*—Knobbe, Martens Olson & Bear

[57] ABSTRACT

A video gaming apparatus that plays an interactive game of poker with a player provides a payback table that is modified at the beginning of each hand to provide at least one bonus card combination which has an increased payback amount. The bonus card combination having the increased payback amount is randomly selected prior to dealing the hand. In addition, the amount by which the payback is increased is also randomly selected. The bonus card combination and the increased payback amount are presented to the player prior to the player making a decision as to how to respond to the dealt hand so that the player must take the odds of completing the bonus card combination into consideration in deciding which cards to hold and which cards to discard and replace with drawn cards. Thus, an additional element of decision-making is added to the basic poker game, thereby providing differentiation between the improved poker game and conventional poker games.

8 Claims, 6 Drawing Sheets

METHOD AND APPARATUS FOR RANDOMLY INCREASING THE PAYBACK IN A VIDEO GAMING APPARATUS

BACKGROUND OF THE INVENTION

1. Field of the Invention

The present invention is in the field of video gaming machines which receive coins or other tokens from a player as payment for playing a game and which provide coins, tokens or credit as outputs to the player in varying amounts depending upon the outcome of the game played by the player.

2. Description of the Related Art

Video gaming machines have become popular alternatives to games played at a table, such as blackjack, poker, or the like, or alternatives to mechanical games such as slot machines or the like. Basically, such video gaming machines provide odds of winning similar to the games which they emulate without requiring a gambling establishment, such as a casino, to hire dealers for card games or to maintain mechanical games such as slot machines. Because of the lower personnel and maintenance requirements, gaming establishments are able to provide more games to more customers. Furthermore, the rate at which a video gaming machine can be played is generally determined by the player. The faster players can play considerably faster than the rate of play at a "live" gaming table or with a mechanical slot machine for example. The slower players can play at a slower pace without the pressure of other players at a table and without slowing down the other players. In any case, it is believed that the flow of money at the gaming establishment is generally improved through the use of the video gaming machines.

Because of the proliferation of video gaming machines, it is important that a gaming establishment have a way of attracting players to its gaming machines as opposed to the gaming machines of other establishments. One method of attracting players is to provide better payback percentages for the video games. Basically, the payback that a game provides is determined by a paytable by which certain combinations of cards (e.g., royal flush, four of a kind, full house, flush, straight, etc., in poker) provide different payback amounts in accordance with the likelihood of such card combinations will occur. In general, the payback amounts are set so that over a long term, the gaming machine will pay back a certain percentage (for example, 93%) of the money deposited in the machine, with the remaining percentage (for example, 7%) going to the gaming establishment. Thus, the goal of each player is to reap a windfall by having the higher payback card combinations occur while he or she is playing the machine and thus be paid from money deposited by other players. By increasing the payback percentages paid, the gaming establishment hopes to attract players that want to increase the likelihood of receiving a significant payback. On the other hand, increasing the payback decreases the gaming establishment's percentage of the total paid into the machine. The gaming establishment obviously needs to increase the cash flow (i.e., deposits into the machine) so that the smaller percentage that it receives is based upon a larger amount so that the overall income from the gaming machine is increased. The present invention is an apparatus and method that is intended to increase the cash flow by encouraging players to play a particular machine more often because of a higher payback percentage so that the winning player is benefitted by the higher payback and so that the gaming establishment is benefitted by the increased cash flow.

SUMMARY OF THE INVENTION

The present invention is an improved video poker game which adds elements of chance and skill to a conventional video poker game to enhance the attractiveness of the game to a player. One aspect of the present invention is an apparatus that plays an interactive game of chance with a player in response to a monetary wager and commands from the player. The apparatus provides the player with monetary output when the interactive game is concluded if the player has obtained one of a predetermined number of levels of winning results. The monetary output varies in accordance with the levels and with an amount of the monetary wager. The apparatus comprises a processor which generates the interactive game of chance and which receives commands from the player indicative of the monetary wager and indicative of a playing decision. The processor generates a random play of the game of chance to produce a random outcome. The random outcome is one of the predetermined number of levels of winning results or of a plurality of non-winning results. The outcome is compared to a table of monetary outputs to provide the player with a monetary output determined by the randomly selected outcome and the monetary wager. A bonus routine within the processor randomly selects a level of winning results as a bonus level. The bonus routine increases the monetary output for the one level if the bonus level and the random outcome of a current game match. Preferably, the interactive game is a poker game and the predetermined levels of winning results comprise possible poker hands that can be obtained from five cards organized in accordance with calculated odds of obtaining the possible poker hands.

Another aspect of the present invention is a method for determining the payout from a gaming device which generates a randomly selected outcome from a plurality of potential outcomes at the end of each game played on the gaming device. The potential outcomes include a plurality of winning outcomes which activate a payout in accordance with a predetermined paytable. The paytable includes a plurality of levels of winning outcomes where each level has a different payout. The method comprises the steps of randomly selecting one of the levels of winning outcomes as a bonus level for a game, and increasing the payout activated by the randomly selected outcome of the game if the randomly selected outcome is a winning outcome at the bonus level. Preferably, the game is a poker game and the levels of winning outcomes comprise possible poker hands that can be obtained from five cards organized in accordance with calculated odds of obtaining the possible poker hands. Also preferably, each level of winning outcomes has an equal probability of being selected as the bonus level. In a preferred embodiment, the gaming device is responsive to a monetary input of a single monetary unit and multiples of said single monetary unit, and the step of increasing the payout is activated only if the monetary input is a maximum allowable multiple of the single monetary unit. Also, in a preferred embodiment, the paytable comprises a payout amount at each of the levels for each of the multiples of the monetary unit, and the step of increasing the payout comprises the steps of selecting one of the payouts for the bonus level and adding it to the payout for the bonus level at the maximum allowable multiple of the single monetary unit.

Another aspect of the present invention is an electronic poker machine that plays an interactive game of poker with a player by dealing a first poker hand and displaying the hand to the player and permitting the player to selectively draw cards to replace cards in the first poker hand to generate a final poker hand. The machine comprises a first routine that selects a level of poker hands as a bonus level; a second routine that compares the final poker hand to the level of poker hands to determine if the final poker hand is in the bonus level; and a third routine that increases a payout to the player if the final poker hand is in the bonus level.

BRIEF DESCRIPTION OF THE DRAWINGS

The present invention will be described below in connection with the attached drawings in which.

DETAILED DESCRIPTION OF THE PREFERRED EMBODIMENTS

Figure 1:
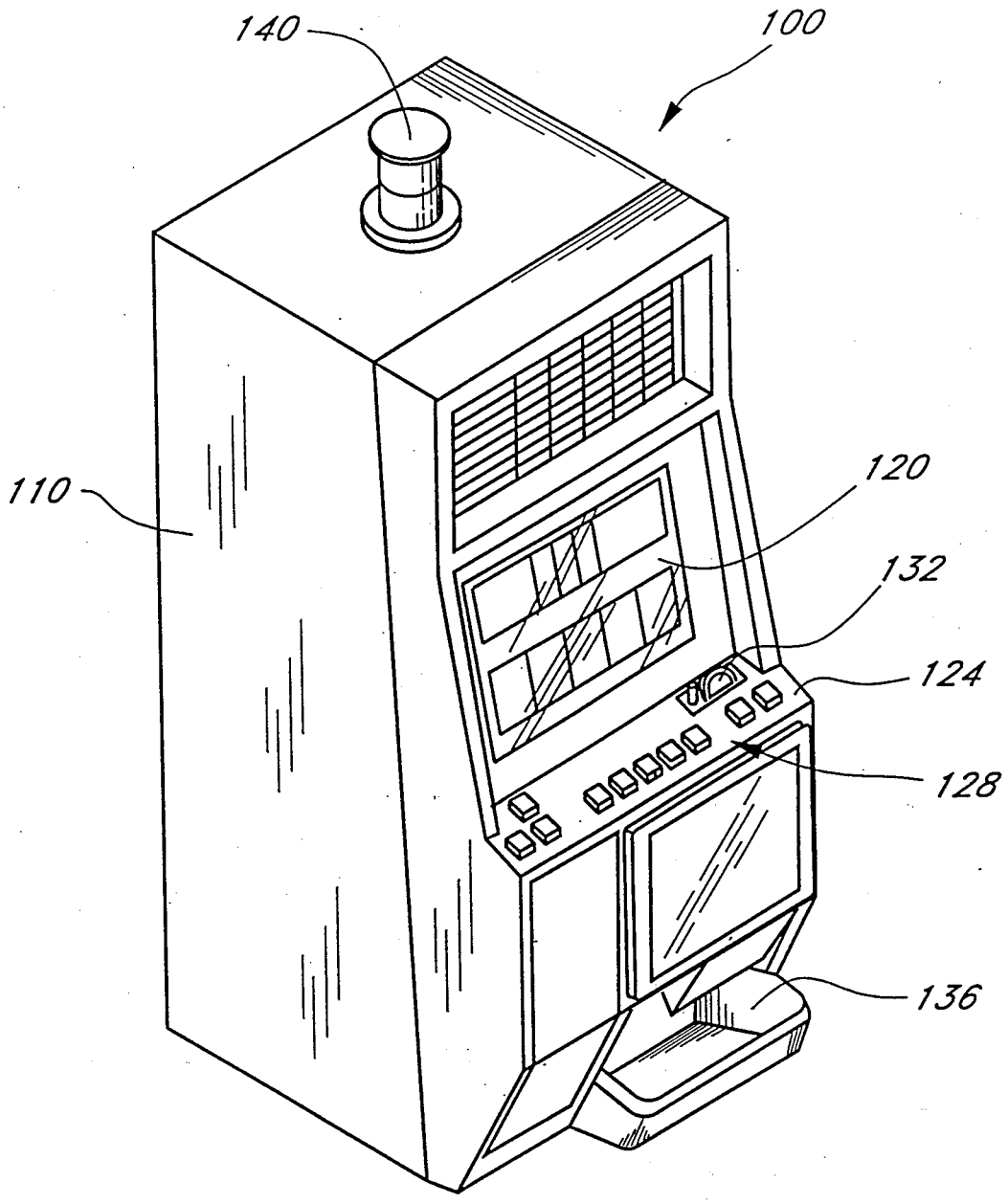
FIG. 1 is a perspective illustration of an exemplary video gaming machine into which the present invention can be incorporated.

FIG. 1 illustrates a video gaming machine 100 into which the present invention can be incorporated to improve the enjoyment of a video game and to thereby increase the amount of time that the video game is played by the patrons of a gaming establishment. As illustrated, the video gaming machine 100 comprises a cabinet 110 which may be a free-standing cabinet that is placed on the floor, or, as illustrated in FIG. 1, is configured to be placed on a counter or other raised support structure. Other configurations of the video gaming machine 100 are also known. For example, the components of video gaming machine 100 may be mounted directly in a table or bar top.

The video gaming machine 100 of FIG. 1 further comprises a video display 120, which, in the preferred embodiment described herein, is advantageously a conventional VGA display monitor such as is commonly used in combination with conventional desktop computers and the like. However, unlike monitors used with desktop computers, the VGA display 120 is mounted directly in the cabinet 110 rather than in a separate cabinet. As will be discussed below, the VGA display 120 displays a simulation of a card game, a reel-type slot machine or other game of chance, and a player using the video gaming machine 100 interacts with the simulated game as if the player were playing a game with a dealer in a card game or as if the player were controlling a mechanical slot machine, for example.

A control panel 124 comprising a plurality of switches 128 is mounted below the video display 120. The control panel 124 is usually mounted at an angle with respect to the front of the cabinet 110 so that a player standing or sitting in front of the video gaming machine 100 can operate the switches 128 for long periods of time without significant effort or discomfort. The function of switches 128 will be described in more detail below; however, it should be understood that the switches 128 enable a player to control the operation of the video game displayed on the VGA display 120, such as, for example, controlling the amount of money to bet, dealing cards in a poker game, and making decisions as to continuation of play (e.g., holding or drawing cards in a video poker game).

The control panel 124 also includes a coin acceptance slot 132 which is positioned to receive one or more coins or tokens from a player to enable the game to be played. A coin output hopper tray 136 is positioned on the cabinet 110 below the control panel 124 to provide storage for coins or tokens which are output from the video gaming machine 100 when a player is to receive payment for winning a game played on the video gaming machine 100. One skilled in the video gaming art will appreciate that a coin mechanism (not shown in FIG. 1) is included within the cabinet 110 that receives coins from the coin acceptance slot 132 and that outputs coins to the coin output hopper tray 136. The operation of such coin mechanisms is well understood within the art, and thus will not be described in detail herein. It should be further understood that some video gaming machines may be operated totally on a credit basis without requiring the use of coins or tokens.

The video gaming machine 100 may also include a signal light 140 which is mounted on top of the cabinet 110 and which may be activated by the video gaming machine 100 in combination with various sounds generated by a speaker (not shown) to indicate a significant winning event by a player. Alternatively, or in addition, the signal light 140 may be controlled by one of the switches 128 to indicate to an employee of a gaming establishment that a player needs coins or tokens to continue playing the video gaming machine 100.

The present invention will be described below in connection with a preferred implementation of a video poker game; however, it should be understood that the present invention can be readily incorporated into other video games.

Figure 2:
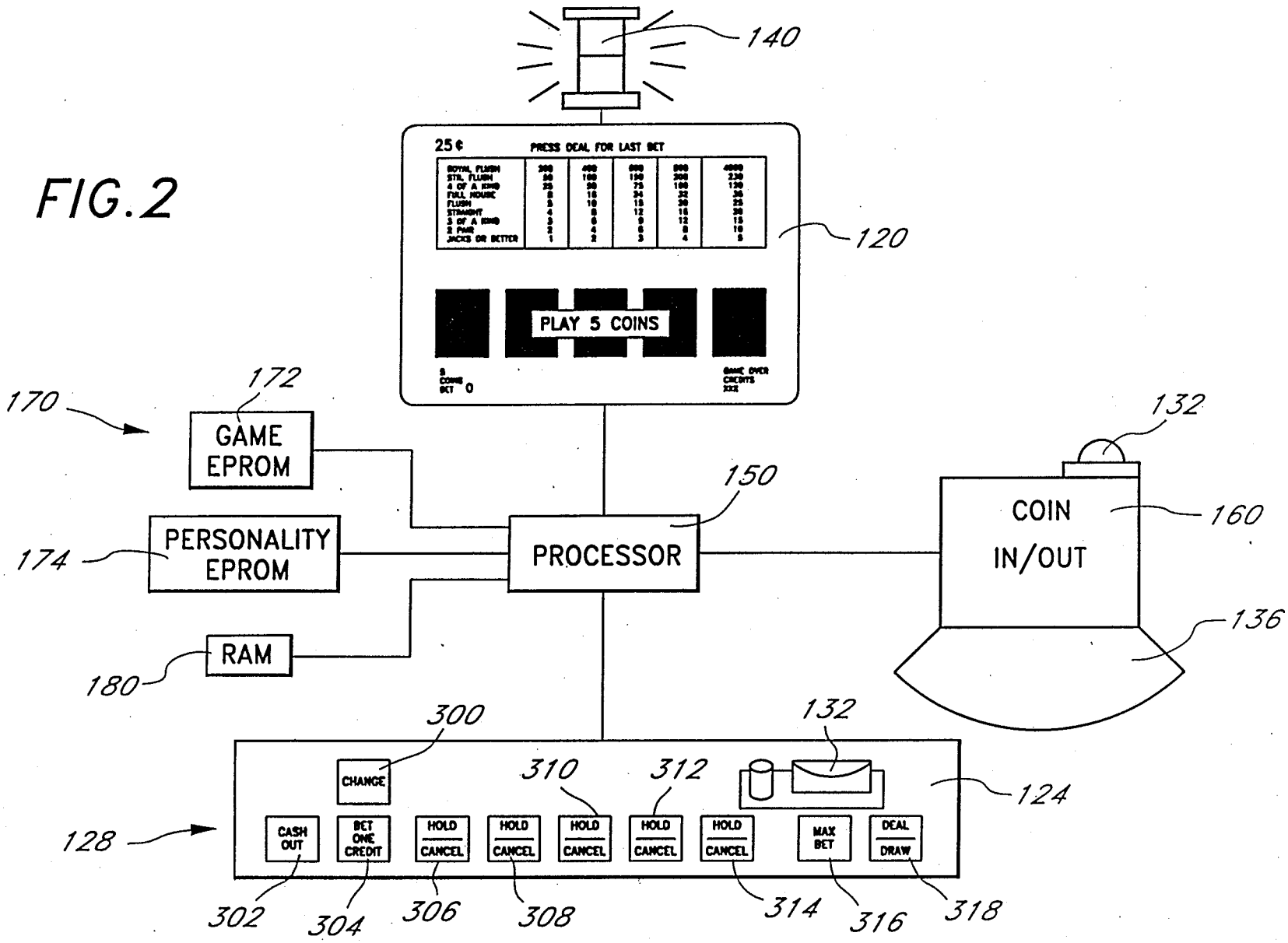
FIG. 2 is a block diagram of the principle components of the video gaming machine of FIG. 1.

FIG. 2 illustrates a block diagram of the video gaming machine 100 of FIG. 1. As illustrated in FIG. 2, the VGA display 120 is controlled by a processor 150, which, in the preferred embodiment, is a microprocessor-based computer system. In particular, the processor 150 has hardware based upon the conventional and wellknown IBM® PC/XT computer system which has an Intel® 8088 microprocessor and various support components to control the VGA display 120 and to provide control of input/output devices. The operation of such 8088 microprocessor-based processor systems is well-known and will not be described in detail herein. Other microprocessors can also be used instead of the 8088 microprocessor.

The processor 150 is electrically connected to the control panel 124 so that the processor 150 receives commands from the switches 128 mounted on the control panel 124 in a conventional manner. The processor 150 is also electrically connected to a coin mechanism 160 which is illustrated in FIG. 2 as a block positioned between the coin acceptance slot 132 and the output hopper tray 136. The control of the coin mechanism 160 by the processor 150 is well-known in the art and will not be described in detail herein. Basically, the processor 150 receives signals from the coin mechanism 160 to indicate when a coin or token has been inserted into the coin acceptance slot 132 and has been accepted as authentic. The processor sends commands to the coin mechanism 160 to cause the coin mechanism 160 to output one or more coins or tokens to the output hopper tray 136 when a player is entitled to payment as a result of playing the video game. Various other signals and commands are interchanged between the processor 150 and the coin mechanism 160 to indicate the status of the coin mechanism. The processor 150 may also generate signals to control the signal light 140 either in response to a significant winning event by a player or in response to activation of one of the switches 128 by which a player may request attention from an employee of a gaming establishment in which the video gaming machine is being played.

The processor 150 is also electrically connected to a memory system 170, which, in the preferred embodiment advantageously comprises at least three different memories. A first game EPROM (erasable programmable read-only memory) 172 comprises software instructions and data to control the overall operation of the processor 150. The first game EPROM 172 may advantageously comprise more than one EPROM. For example, the game EPROM 172 includes the instructions for controlling the VGA display 120, and controlling and responding to the coin mechanism 160 and the control panel 124. Such routines are conventional and generally do not require modification with any significant frequency. The game EPROM 172 also advantageously includes the instructions for simulating the play of the game to be played on the video game machine 100. For example, in the embodiment described herein, the game EPROM 172 includes instructions to generate the graphics necessary to display a set of five cards on the VGA display 120 to represent the five cards dealt to a player in a draw poker game, as shown, for example, on the VGA display 120 and shown more clearly in FIG. 3. The game EPROM 172 also includes the instructions necessary to simulate the shuffling of a "deck" of cards and to randomly pick the cards to be initially displayed and the cards to be displayed if and when a player draws additional cards. The operation of such instructions in interacting with commands from a player via the switches 128 and in controlling the display of the cards is well-known to persons skilled in the video gaming art and will not be described in detail herein. Basically, a card shuffling algorithm is provided that operates in a manner such that the cards are generated in an unpredictable order so that the occurrences of particular card combinations generated by the processor 150 will occur at the same statistical frequency as if a physical deck of cards were shuffled by a live dealer.

A second "personality" EPROM 174 is also electrically connected to the processor 150. The personality EPROM 174 may advantageously comprise more than one EPROM. The personality EPROM 174 is provided to store data and instructions that may change more often in accordance with various specific details of a video game. For example, the amount of winnings that a player may receive in response to particular card combinations in a video poker game can be varied in accordance with a particular payback percentage that a gaming establishment wants to achieve for its video poker games. Rather, than reprogramming the game EPROM 172, the personality EPROM 174 is programmed with the data required to control the amount of winnings, for example. Various other variable functions of video game machines are also controllable by the personality EPROM 174. For example, whether or not a player can accumulate credit on a machine or is paid with coins at the end of each winning play; the total amount of credit that a player can accumulate before having to start accepting coin payouts; the maximum number of coins or equivalent credit that can be bet on each hand; etc., are examples of parameters that can be changed by replacing the personality EPROM 174 without requiring the game EPROM to be changed. The use of the two EPROMs 170, 174 (or more EPROMs) advantageously allows the functions and limitations that must be approved by gaming regulators to be stored in the game EPROM 172 and functions and limitations that can be varied by a gaming establishment to be stored in the personality EPROM 174.

A RAM (random access read/write memory) 180 is also electrically connected to the processor 150. The RAM 180 is used to store temporary variables, such as the results of shuffling the "card deck," a player's current bet, a player's credit, various status flags, and the like. The processor 150 stores data in the RAM 180 and retrieves data from the RAM 150 as needed during the operation of the video gaming machine 100. Preferably, all or a portion of the RAM 180 comprises non-volatile memory (e.g., battery backed-up RAM) which will maintain the data stored therein in the event of a temporary power failure, or the like, so that when the operation of the video gaming machine 100 is restored, a player can continue in a current game and will not have lost any accumulated credit.

Figure 3:
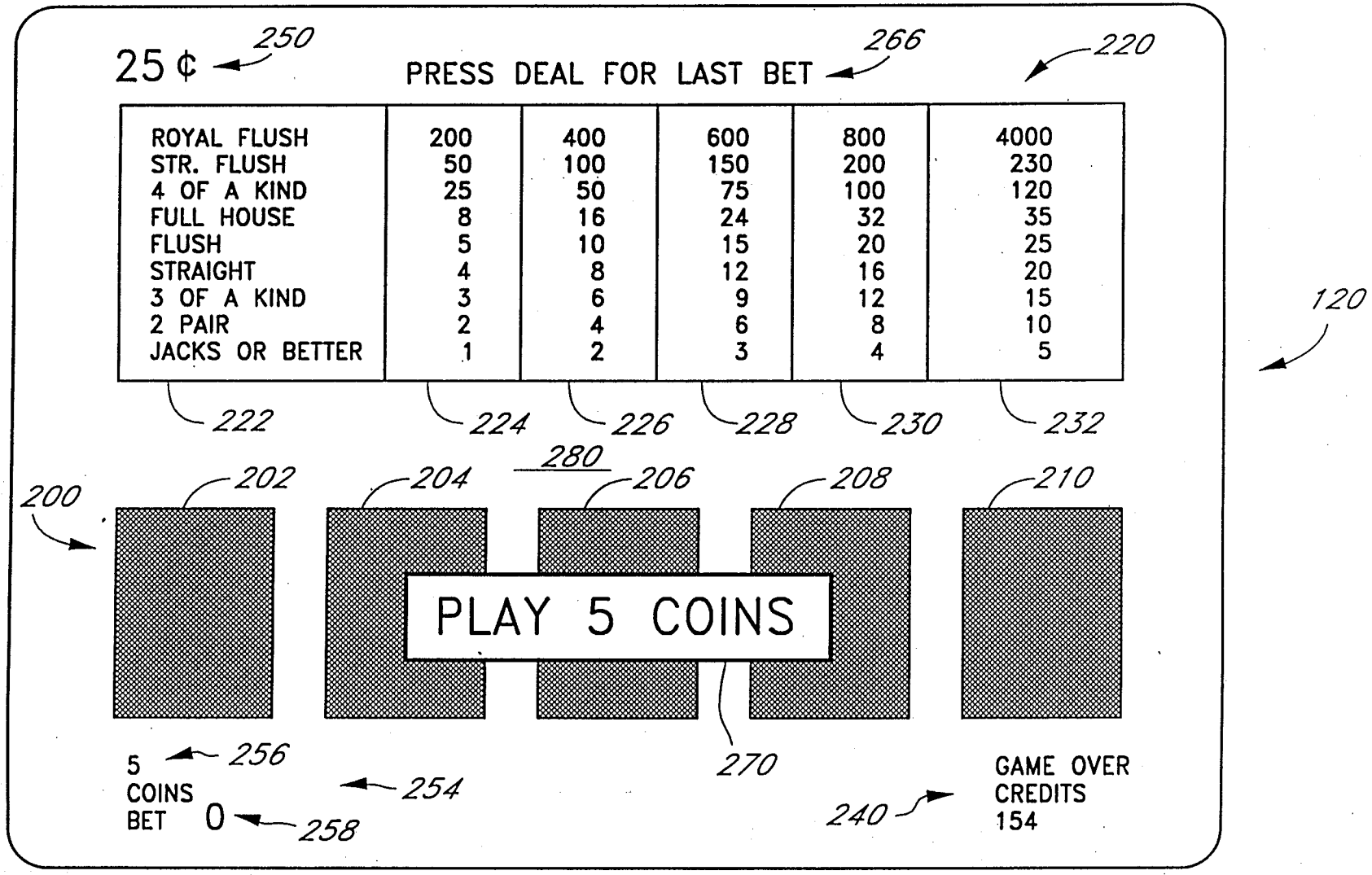
FIG. 3 illustrates an exemplary video control panel and video screen of the video gaming machine of FIG. 1 showing a display for a video poker game into which the present invention can be incorporated.

Referring now to the details of the VGA display 120 and the control panel 124 in FIG. 3, it can be seen that the video poker game described herein is represented on the VGA display 120 as a number of portions. The primary portion is the card display portion 200 which comprises a first card 202, a second card 204, a third card 206, a fourth card 208 and a fifth card 210. The five cards can be displayed either with a representation of the back of a card or a representation of the front of a card.

A paytable portion 220 comprises a table having a first (left-most) column 222 that displays the winning card combinations (e.g., ROYAL FLUSH, FOUR OF A KIND, etc.). A second column 224 displays the number of coins (or equivalent credit) returned to the player when a particular combination of cards is dealt to the player when the player has bet one coin. A third column 226 displays the number of coins (or equivalent credit) returned to the player when a particular combination of cards is dealt to the player when the player has bet two coins. A fourth column 228 displays the number of coins (or equivalent credit) returned to the player when a particular combination of cards is dealt to the player when the player has bet three coins. A fifth column 230 displays the number of coins (or equivalent credit) returned to the player when a particular combination of cards is dealt to the player when the player has bet four coins. A sixth column 232 displays the number of coins (or equivalent credit) returned to the player when a particular combination of cards is dealt to the player when the player has bet five coins. As illustrated, the number of coins returned increases with the decreasing probability that a player will be dealt a particular card combination, with a frequently occurring combination (two Jacks, two Queens, two Kings or two Aces) returning only the amount of the bet, and the substantially less frequently occurring combination of a Royal Flush returning 200 times the amount of the bet. The amount of the return is generally set based upon the statistical occurrences of the card combinations so that over an extended period of time, if the card combinations occur in accordance with the statistical prediction, the video gaming machine 100 will pay out a predetermined percentage of the coins deposited in it. For example, the numbers shown in the second column of the paytable portion 220 represent a payout percentage of approximately 93%.

The third, fourth, fifth and sixth columns 226, 228, 230, 232 show payout amounts that are multiples (i.e., two times, three times, four times and five times, respectively) of the payout amounts in the second column for one coin. For example, each of the payout amounts in the fourth column for a player betting three coins is three times the corresponding amount for the same card combination in the second column for a player betting one coin. Generally, many video game machines 100 are configured (via the personality EPROM 174 discussed above) to modify the payout amount for the most unlikely combination (e.g., the Royal Flush) when an ambitious player is betting five coins. Thus, instead of receiving a payout of 1,000 coins which is five times the amount in the first column, a player dealt a Royal Flush on a bet of five coins will receive a payout of 4,000 coins in the illustrated embodiment. This adds an increased level of expectation for players and encourages players to bet five coins (or equivalent credit) for each deal and thus increases the cash flow to the gaming establishment. Thus, although the overall percentage of profit on the video gaming machine 100 will be slightly reduced by the increased payout to a player being dealt a Royal Flush on a five-coin bet, the increased cash flow should result on a higher overall profit.

The paytable 220 is electronically represented as digital data in the personality EPROM 174 (FIG. 2), and is accessed by the processor 150 when the processor 150 determines that a player has been dealt a winning card combination. The processor 150 indexes the paytable stored in the EPROM 174 using the card combination and the number of coins bet as parameters and then outputs commands to credit the player with the number of coins that the player has won. Generally, this is accomplished by increasing the credit stored in the RAM 180 and displaying the credit on the VGA display 120 at a location 240, for example. Alternatively, or in response to a player request, the winnings can be output as coins or tokens via the coin hopper tray 136.

The VGA display 120 includes other display portions which indicate the status of the video game machine 100 and which instruct the player. At the upper left portion 250 of the VGA display 120 is indicator that informs a player of the denomination of the coin for which the video gaming machine 100 is configured (e.g., 25 cents, indicating that the machine is operated with quarters or quarter tokens). The video gaming machine can be reconfigured by replacing the coin mechanism 160 and changing the personality EPROM 174 to display a different denomination in the portion 250.

Figure 5:
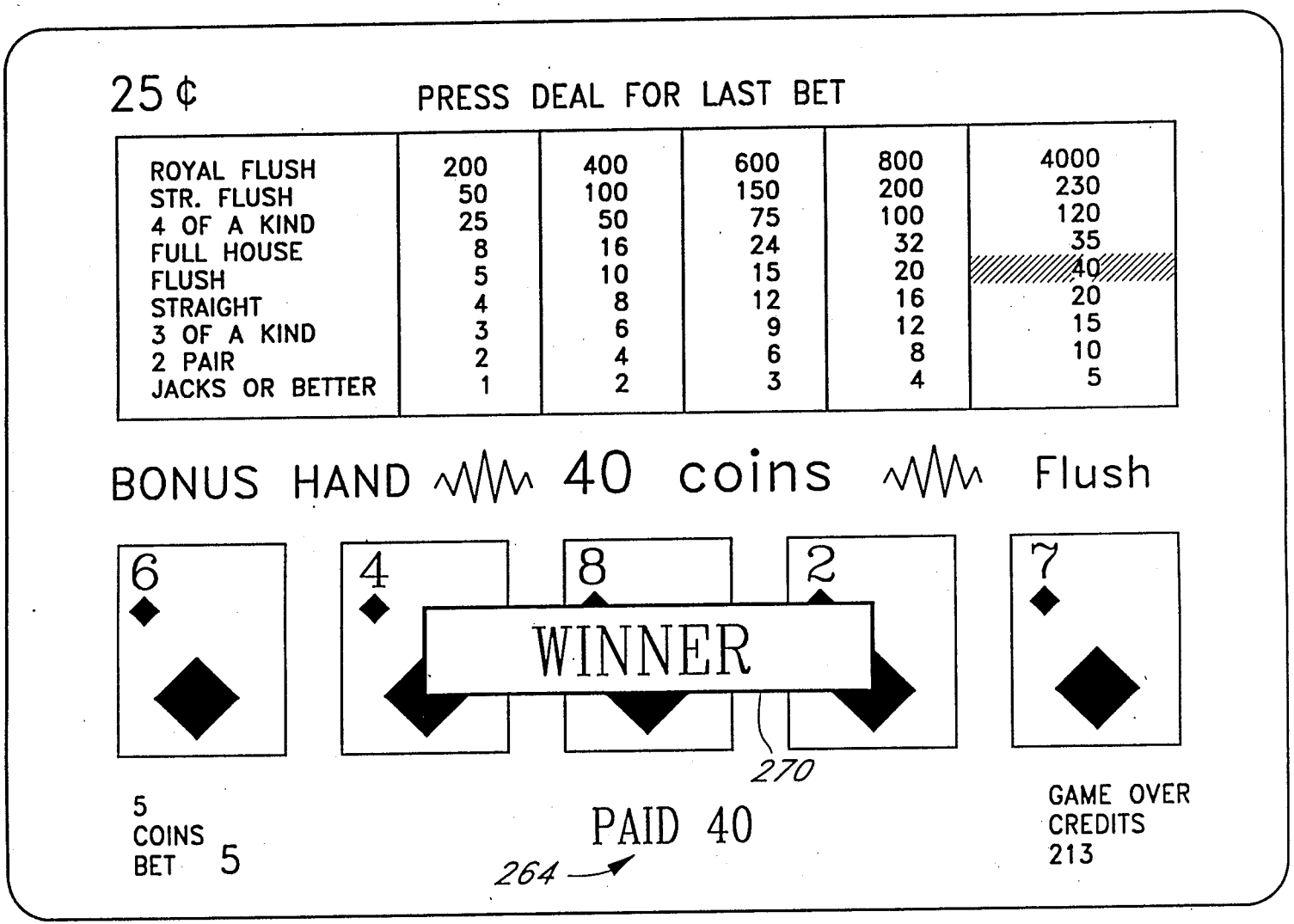
FIG. 5 illustrates an exemplary video screen of the video gaming machine of FIG. 1 showing the change in the display when the player is being alerted to the upcoming double bonus time.

A lower left portion 254 displays the current bet 256 and the previous bet 258. A lower middle portion 264 (see FIG. 5) is activated temporarily when a player is dealt a winning combination to indicate the number of coins being paid (or credited). An upper middle portion 266 is activated between deals to remind a player that by simply pressing a deal button (described below), that the player will be making the same bet and will have that amount deducted from his or her credit.

A temporary banner portion 270 is provided that overlies the middle three cards 204, 206, 208. The temporary banner portion 270 displays "PLAY 5 COINS" when no game is being played. This mode of operation is referred to as the attract mode and is used to encourage a player to play or continue playing the video game machine 100. When the cards are dealt by the video game machine 100, the banner portion 270 is blanked out so that the cards are not obstructed. If a player is dealt a winning combination, the temporary banner portion 270 displays the words "WINNER" to confirm the winning combination. The display may be accompanied by suitable sounds to announce the win to other players in the vicinity.

The paytable 220 and the cards 200 are separated by a separator portion 280 which may be used in conventional machines to display the title of the video game being played. The video gaming machine 100 of the present invention 100 uses the separator portion 280 for an advantageous purpose of displaying a bonus card combination, as will be described in detail below.

As further illustrated in FIG. 2, in the described embodiment, the switches 128 on the control panel 124 comprise a CHANGE switch 300, a CASH OUT switch 302, a BET ONE CREDIT switch 304, a first HOLD/CANCEL switch 306, a second HOLD/CANCEL switch 308, a third HOLD/CANCEL switch 310, a fourth HOLD/CANCEL switch 312, a fifth HOLD/CANCEL switch 314, a MAX BET switch 316 and a DEAL/DRAW switch 318.

The switches 128 operate in conventional manners to control the video gaming machine 100. Briefly, the CHANGE switch 300 is connected to the signal light 140, either directly or through interaction with the processor 150, to activate the signal light 140 when change is required or a player otherwise requests the attention of an attendant. The CASH OUT switch 302 is activated by a player when the player has accumulated credit while playing and wants to receive coins or tokens corresponding to the accumulated credit. The BET ONE CREDIT switch 304 is activated when a player wants to bet a credit for a game. When activated once, the BET ONE CREDIT switch 304 changes the current bet portion 256 from 0 to 1. If the BET ONE CREDIT switch is again activated, the current bet portion is changed to 2 and so on up to the maximum that can be bet on each hand (e.g., 5 in the preferred embodiment). At the same time, the appropriate column of the paytable 220 is highlighted to show the player the payout that will be provided in the event that a winning combination is dealt to the player.

The MAX BET switch 316 is used to expedite the betting by automatically betting the maximum amount that can be bet on a particular video gaming machine 100, which, in the preferred embodiment, is five coins (five equivalent credits). The DEAL/DRAW switch 318 serves a dual purpose of dealing the five cards for a new hand after a bet has been selected by a player (i.e., "DEAL"), and of drawing new cards if the player is not satisfied by some or all of the cards dealt on the new hand and desires to draw one or more replacement cards ("DRAW"). The first, second, third, fourth and fifth HOLD/CANCEL switches 306, 308, 310, 312 and 314 select the cards to be held or canceled when the new cards are drawn. In the preferred embodiment, the switches 306–314 are used to "HOLD" cards that a player wants to keep. When a particular HOLD/CANCEL switch is activated, the card having the same relative position as the switch is held. For example, when the first HOLD/CANCEL switch 306 is activated, the first card 202 is indicated as being held by the appearance of the words "HOLD" (not shown) above the card. Each HOLD switch 306–314 operates in a toggle mode such that if the switch is again activated, the HOLD indication will turn off. Thus, a player can change his or her mind before drawing. After the player has selected the cards to be held, the player then pushes the DEAL/DRAW switch 318 to cause the cards that are not held to be replaced with different cards. The processor 150

(FIG. 2) then determines from the resulting five cards whether the player has been dealt one of the winning combinations and credits or pays out the appropriate amount accordingly. Alternatively, the personality EPROM 174 can be programmed so that the HOLD/CANCEL switches 306–314 operate as cancel switches whereby each card is automatically held unless specifically canceled by the player. Again the switches will operate as toggle switches so that the cancellation can be turned off and on until the player pushes the DEAL/DRAW switch 318 to initiate the draw of replace cards.

The foregoing description of the video gaming machine 100 is generally applicable to a large number of video games manufactured by a number of different manufacturers which provide the same basic simulation of a poker game or other similar game. When used with other games, the control panel 124 will have a different configuration and identification of the switches 128 to control the functions required for the game being simulated. For example, in a reel-type slot machine (not shown), the HOLD/CANCEL switches 306–314 are not required, and the DEAL/DRAW switch 318 operates to cause the reels to start moving.

Figure 6:
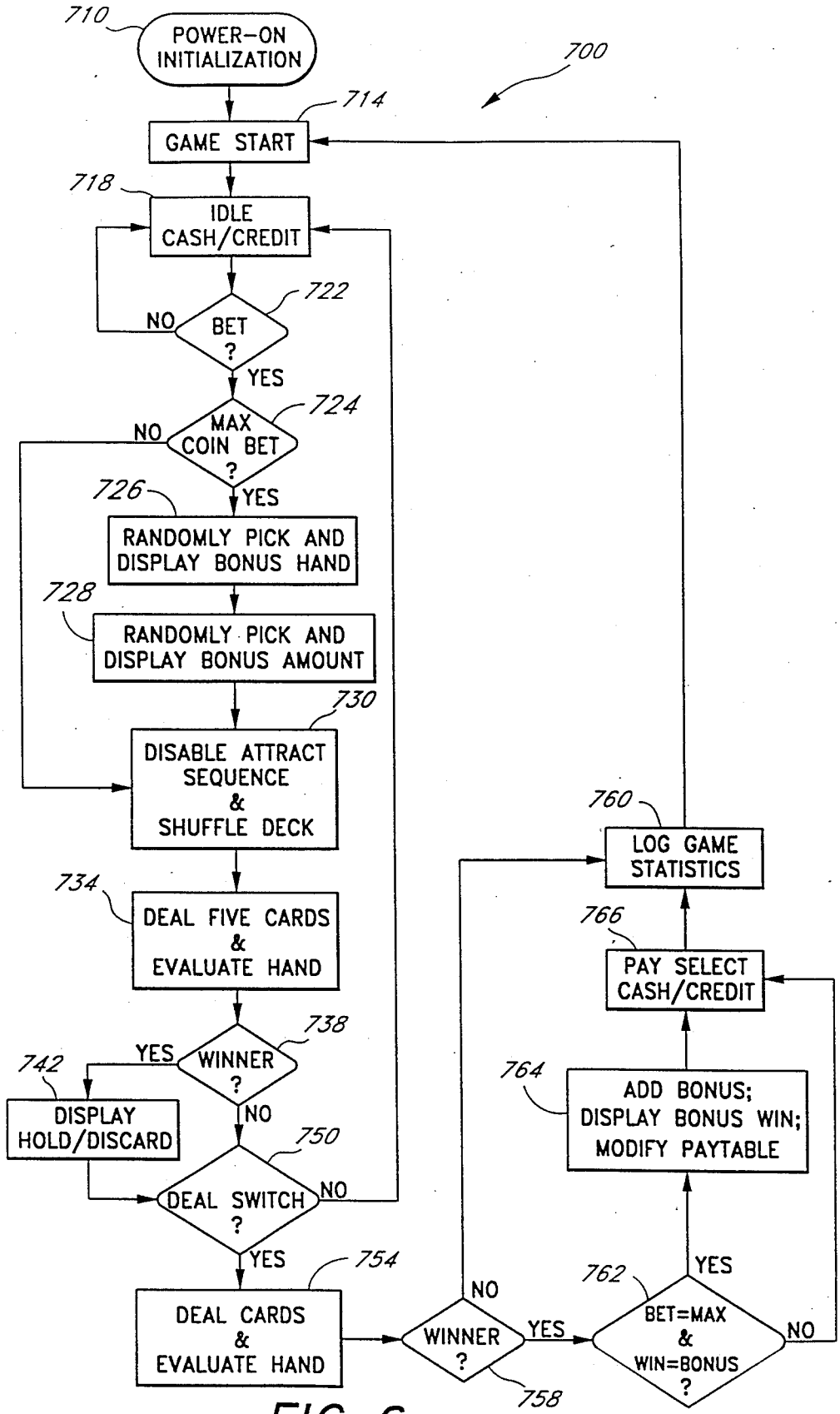
FIG. 6 is an exemplary flow chart of the overall operation of the video gaming machine of FIG. 1 in accordance with the present invention.

It can be seen from the foregoing that the generalized video poker game produced by one manufacturer will provide similar playing characteristics with a video poker game manufactured by another manufacturer. Thus, in order to increase the usage of a particular video poker game, it is desirable to provide unique operating characteristics that are different from other games and that attract players to the game. The present invention provides such unique operating characteristics as described below in connection with FIGS. 4–6.

Figure 4:
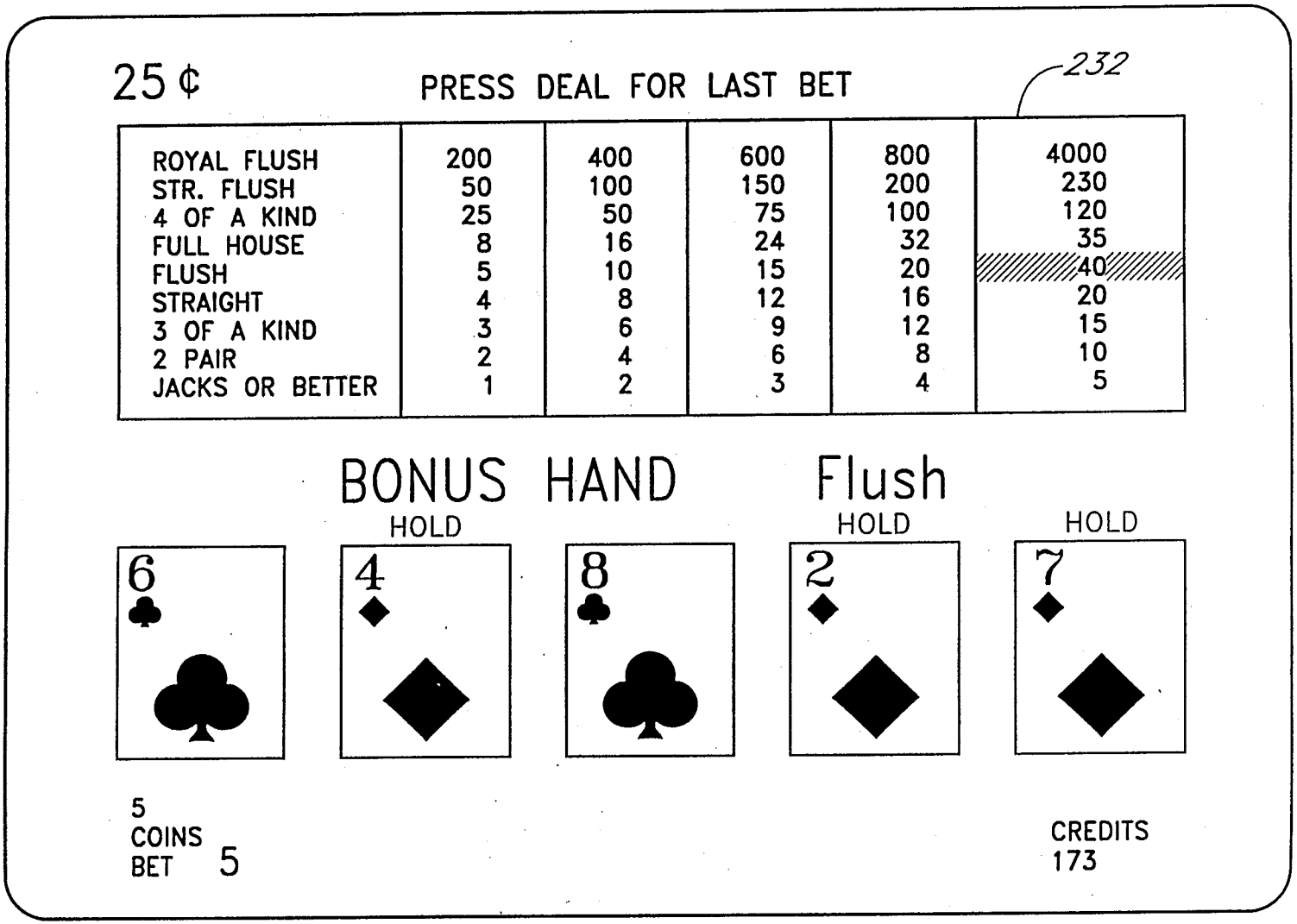
FIG. 4 illustrates an exemplary video screen of the video gaming machine of FIG. 1 showing the change in the display during the double bonus time.

FIG. 4 is an exemplary screen display in accordance with the present invention which shows a bonus message approximately in the middle of the display which indicates the state of the bonus play for the current hand. In particular, the bonus message designates the level of the current hand that must be obtained in order to receive the bonus amount. For example, in the exemplary implementation in a video poker game, the nine levels are JACKS OR BETTER, TWO PAIR, THREE OF A KIND, FLUSH, STRAIGHT, FULL HOUSE, FOUR OF A KIND, STRAIGHT FLUSH and ROYAL FLUSH. The processor 150 includes a routine that is executed at the beginning of each hand when the maximum bet is input to the video game machine, either by inserting the maximum number of coins or by selecting the maximum number of credits, as discussed above. The routine randomly selects one of the nine levels as the bonus level before the hand is randomly dealt. Thus, the bonus level is selected independently of the cards which will be dealt on the initial deal of the current hand. For example, in FIG. 4, the banner displays "BONUS HAND Flush" to indicate that if the result of the current hand is a FLUSH, the player will receive a bonus payout instead of the conventional payout. In addition, in the preferred embodiment, the amount of the bonus is randomly selected by selecting one of the payback amounts from the wagering levels for the selected bonus level. For example, if the selected bonus level is FLUSH, as illustrated in FIG. 4, and if there are five possible monetary bets that can be made (e.g., 1 coin, 2 coins, 3 coins, 4 coins and 5 coins), the conventional embodiment shown has paybacks of 4, 8, 12, 16 and 20 coins in accordance with one exemplary payback table. In the preferred embodiment, a random number of 1, 2 or 3 is selected to provide a bonus of 5 coins, 10 coins or 15 coins which will be added to the normal payback of 25 coins if a FLUSH is dealt to the player, either initially or after drawing additional cards. Thus, for example, in FIG. 4, a bonus level of 3 has been selected to cause the fifth coin payout for a FLUSH to be increased from 25 coins to 40 coins. Preferably, the fifth coin payout amount will be highlighted with a different color or by reverse video, as illustrated in FIG. 4 to emphasize the bonus payout amount to the player. It can be seen that the other payback amounts have not been changed in FIG. 4 so that the player will continue to receive the conventional payout amounts if the current hand does not result in a FLUSH.

Although embodiments of the present invention can also select random numbers of 4 or 5, in the embodiment described herein, the numbers 4 and 5 are reserved for payback bonus selection only at the highest level (i.e., ROYAL FLUSH). For example, in the preferred embodiment, if the ROYAL FLUSH level is selected as the bonus level, a random number of 1, 2, 3, 4 or 5 is selected and the payback column corresponding to the selected random number is added to the normal payback. It should be noted that for the ROYAL FLUSH, if the random number 5 is selected, the bonus payback is equal to the normal payback to effectively double the payout if a ROYAL FLUSH is initially dealt to the player or drawn by the player. In a particularly preferred embodiment, the 5-coin ROYAL FLUSH payout is disproportionately higher than the lesser coin payouts for a ROYAL FLUSH. For example, the ROYAL FLUSH payouts for 1-coin, 2-coin, 3-coin, 4-coin and 5-coin wagers are advantageously 200, 400, 600, 800 and 4,000 coins, respectively, such that the ROYAL FLUSH bonus payouts are 4,200 (4,000+200) coins, 4,400 (4,000+ 400) coins, 4,600 (4,000+600) coins, 4,800 (4,000+800) coins, 8,000 (4,000+ 4,000) coins, respectively.

One skilled in the art will appreciate that the payback percentage of a particular machine is a function of both the probability of obtaining a particular hand and the payback for that particular hand at each wagering level. A casino operator, for example, is not likely to want to pay back more coins than are wagered over a long period of time. Thus, the paybacks at each level are selected in accordance with the probability of obtaining a particular hand on a deal or by drawing additional cards. As seen by the table in FIG. 3, in a conventional video poker gaming machine that does not implement the present invention, the payback values for the more frequently occurring hands are lower, and the payback amounts are directly proportional to the number of coins wagered. Typically, as a bonus for betting the maximum number of coins and for being dealt or drawing a ROYAL FLUSH while betting the maximum amount, the payback for a ROYAL FLUSH at the maximum wagering level is disproportionate to the payback for a ROYAL FLUSH at lower wagering levels. For example, for the payback table illustrated in FIG. 3, the overall payback percentages at the 1-coin, 2-coin, 3-coin and 4-coin wagering amounts for all levels of hands are approximately 94.5 percent. On the other hand, the payback percentage for the 5-coin wagering amount is approximately 98.5 percent, which is within a 4-percent range permitted by certain state gaming laws (e.g., in Nevada). When the present invention is implemented, the bonuses paid at the 5-coin wagering amounts affects the overall payback percentage for the 5-coin wagering amount. Thus, as illustrated by the payback table in FIG. 4, the payback amounts for selected hands (e.g., the FULL HOUSE, FOUR OF A KIND and the STRAIGHT FLUSH) are reduced to keep the 5-coin payback percentage within 4 percent of the payback percentages for the other wagering amounts. For example, the 5-coin payout for the three selected hands are reduced from 40, 125 and 250, respectively, to 35, 120 and 230, respectively. Statistically, although the conventional payout for the three hands at the 5-coin wagering level will be less, the overall payout amounts at the 5-coin level as a result of the bonuses and the probability of receiving the bonus is higher.

It can be seen from the foregoing, that a player is provided with a tremendous incentive to bet both the maximum number of coins (e.g., 5 coins in the preferred embodiment) that can be bet on each hand and also to play for the bonus payout at each hand. For example, if the bonus level selected for a particular hand is ROYAL FLUSH, a player may be induced to forego a sure winner with a pair of Aces, and discard one of the Aces to try to win the 4,000 coin bonus for a ROYAL FLUSH. Although the overall payback that a casino will have to provide for a particular machine may not differ significantly by suitable selection of the payback amounts at each level and for each wager, a player will be induced to make the largest wager and seek the largest return. Thus, it is expected that the coin flow will increase, which, without increasing the payback percentage will increase the profit to the casino from the gaming machine.

The foregoing advantageous features of the present invention are implemented in the preferred embodiment by the processor 150 as controlled by the game EPROM 172. As illustrated in an overall flow chart 700 in FIG. 6, on first applying power to the video gaming machine, the processor 150 of the present invention first enters an initialization routine 710 in which the processor 150 performs self-test functions to assure that the various electronic components are operating properly, and the processor 150 then initializes various parameters in accordance with data in the game EPROM 172 and the personality EPROM 174.

After initialization, the processor 150 proceeds to a game start routine 714 in which the processor 150 generates the attract screen display illustrated above in connection with FIG. 3. Thereafter, the processor 150 proceeds to a idle-cash/credit routine 718 in which the processor 150 monitors the coin mechanism 160 to determine whether any additional coins have been added and monitors the switches 128 on the control panel 124 to determine if a player is making a bet or is requesting that his or her credit be cashed out, for example. If, in a decision routine 722, the player has made a bet, the processor 150 proceeds to bet evaluation routine comprising a decision routine 724 in which the processor 150 determines whether the maximum coins (e.g., 5 coins) have been wagered for the current hand. If the maximum coins have been bet, the processor 150 enters a bonus hand picking routine 726 in which the processor 150 randomly selects a bonus hand by randomly selecting a number from 1 to 9 to represent each of the nine possible levels of hands. Any conventional random number generation program can be used in the picking routine 726. Each of the nine levels has an equal probability of occurring such that statistically each hand will be picked substantially the same number of times as each other hand.

After selecting the bonus level, the processor 150 enters a bonus amount selection routine 728 wherein the processor 150 selects a bonus amount for the selected bonus level. As discussed above, if the bonus level is any level other than the ROYAL FLUSH, the payout amounts from the 1-coin, 2-coin or 3-coin column is selected. Thus, the processor 150 randomly selects a value of 1, 2 or 3, and then uses the randomly selected value as an index to the payout table to select the corresponding payout amount for the bonus level and the column. The selected payout amount is added to the 5-coin payout amount and the sum is displayed in the 5-coin payout column and highlighted, as discussed above. If, in the bonus hand selection routine 726, the processor 150 selects the ROYAL FLUSH as the bonus hand, then in the bonus amount selection routine 728, the processor 150 randomly selects a value of 1, 2, 3, 4 or 5 to index the ROYAL FLUSH payout columns, and then selects the corresponding payout amount to add to the 5-coin payout amount.

After selecting the bonus hand and amount and displaying the bonus hand and the modified payout table, the processor 150 enters a first game play routine 730 to play the game, as described below. Returning to the decision routine 724, if the player has not wagered 5 coins, the processor 150 enters the first game play routine 730 directly without determining or displaying a payout amount.

In the first game play routine 730, the processor 150 disables the attract sequence and "shuffles" the card deck in accordance with a conventional card shuffling routine. Thereafter, the processor 150 proceeds to a second game play routine 734 in which it "deals" five cards by displaying the first five cards output by the shuffling routine on the VGA display 120. In addition, in preferred embodiments of the present invention, the processor 150 evaluates the dealt cards in a decision routine 738 to determine if two or more of the cards comprise a winning combination (e.g., a pair of Jacks or better). If so, the processor 150 proceeds to a display routine 742 in which the processor 150 automatically displays the HOLD indicator above the cards comprising the winning combination to assist the player in recognizing that a winning combination has been dealt. The player has the option of pressing the corresponding HOLD/CANCEL button to clear the automatic HOLD indicator if the player wants to discard one or more of the cards in the winning combination (e.g., discard a card in a pair in order to play for a straight or a flush). In either case, the processor 150 proceeds from the display routine 742 or from the decision routine 738 to a DEAL/DRAW switch monitoring routine 750 wherein the processor 150 waits until the player activates the DEAL/DRAW switch 318 to cause the processor 150 to discard the non-held cards. While the processor 150 is waiting in the monitoring routine 750, the player may change the hold condition for any of the five cards, and the processor 150 will display the hold indicator for any card that is currently being held.

When the processor 150 senses that the DEAL/DRAW switch has been activated, the processor 150 proceeds to a third game routine 754 in which the processor 150 deals replacement cards for the cards that were not held by the player and then evaluates the resulting hand. In a decision routine 758, the processor 150 determines whether the resulting hand comprises a winning combination. If not, the processor 150 proceeds directly to a statistic logging routine 760 in which it logs the information relating to the hand just played (e.g., the amount of the bet, the hand dealt, etc.). On the other hand, if the resulting hand was a winning combination, the processor 150 proceeds to a decision routine 762 wherein the processor 150 determines whether the maximum bet (e.g., 5-coins in the preferred embodiment) were wagered on the current hand and whether the result of the current hand matches the bonus hand. If the maximum bet was wagered and if the current hand matches the bonus hand, the processor 150 enters a bonus routine 764 wherein the processor 150 adds the bonus amount to the conventional payout amount from the payout table and stores it in the paytable currently in the RAM 180. The processor then displays the bonus winning banner illustrated in FIG. 5. Preferably, the bonus winning banner is a dynamic banner in which the words "BONUS HAND" and the words indicating the level of the bonus hand move apart from the center of the banner and the amount of the payout appears in the center of the banner.

After calculating the bonus payout amount, the processor 150 enters the payout routine 766 in which the processor 150 uses the winning combination and the amount bet as an index to access the paytable currently in the RAM 180 to determine how much to pay out to the player. If the winning hand was not the bonus hand, the processor 150 enters the payout routine 766 directly without modifying the payout table in the RAM 180.

The payout may be in the form of coins or tokens deposited directly into the coin hopper tray 136, or, in the preferred embodiments of the present invention, the payout is provided to the player as an increase in the credit displayed on the VGA display 120.

It should be understood that in the preferred embodiment, the underlying ROM-based payout table is not changed when the bonus hand and bonus amount are initially selected in the routines 726 and 728 discussed above. Rather, only the payout display is changed. Thus, the bonus routine 764 adds the bonus amount to the RAM-based payout table only if the bonus hand is dealt.

Thereafter, the processor enters the statistic logging routine 762 in which the information is logged, as discussed above, along with the amount of the payout. It should be understood by one skilled in the art that the video gaming machine 100 may advantageously include mechanical bet and payout counters (not shown) which are updated by the processor 150 while executing the logging routine 762 so as to maintain a permanent record of machine income and payout that will not be altered by a power failure or by tampering.

After completing the statistic logging routine 762, the processor 150 then returns to the game start routine 714 wherein the attract screen is again displayed until the next bet is made.

The invention may be embodied in other specific forms without departing from its spirit or essential characteristics. The described embodiments are to be considered in all respects only as illustrative and not restrictive. The scope of the invention is therefore indicated by the appended claims rather than by the foregoing description. All changes which come within the meaning and range of equivalency of the claims are to be embraced within that scope.

We claim:

1. An apparatus that plays an interactive game of chance with a player in response to a monetary wager and commands from the player, said apparatus providing the player with monetary output when said interactive game is concluded if the player has obtained one of a predetermined number of levels of winning results, said monetary output varying in accordance with said levels and with an amount of said monetary wager, said apparatus comprising:

a processor which generates said interactive game of chance and which receives commands from the player indicative of said monetary wager and indicative of a playing decision, said processor generating a random play of said game of chance to produce a random outcome, said random outcome being one of said predetermined number of levels of winning results or of a plurality of non-winning results, said outcome compared to a table of monetary outputs to provide the player with a monetary output determined by said randomly selected outcome and said monetary wager; and a bonus routine within said processor that randomly selects a level of winning results as a bonus level, said bonus routine increasing said monetary output for said one level if said bonus level and said random outcome of a current game match.

2. The apparatus as defined in claim 1, wherein said interactive game is a poker game and wherein said predetermined levels of winning results comprise possible poker hands that can be obtained from five cards organized in accordance with calculated odds of obtaining said possible poker hands.

3. A method for determining the payout from a gaming device, said gaming device randomly selecting a selected outcome from a plurality of potential outcomes and displaying said selected outcome at the end of a game played on said gaming device, said potential outcomes including a plurality of winning outcomes which activate a payout in accordance with a predetermined paytable, said paytable including a plurality of levels of winning outcomes, each level having a different payout, said randomly selected outcome activating one of said different payouts when said randomly selected outcome is one of said plurality of winning outcomes, said method comprising the steps of:

randomly selecting one of said levels of winning outcomes as a selected bonus level for a game; and increasing said one of said different payouts activated by said randomly selected outcome of said game if said randomly selected outcome is a winning outcome and said randomly selected outcome is at said selected bonus level.

4. The method as defined in claim 3, wherein said game is a poker game and wherein said levels of winning outcomes comprise possible poker hands that can be obtained from five cards organized in accordance with calculated odds of obtaining said possible poker hands.

5. The method as defined in claim 3, wherein each level of winning outcomes has an equal probability of being selected as said bonus level.

6. The method as defined in claim 3, wherein said gaming device is responsive to a monetary input of a single monetary unit and multiples of said single monetary unit and wherein said step of increasing said one of said different payouts is activated only if said monetary input is a maximum allowable multiple of said single monetary unit.

7. A method for determining the payout from a gaming device, said gaming device randomly selecting a selected outcome from a plurality of potential outcomes and displaying said selected outcome at the end of a game played on said gaming device, said potential outcomes including a plurality of winning outcomes which activate a payout in accordance with a predetermined paytable, said paytable including a plurality of levels of winning outcomes, each level having a different payout, said randomly selected outcome activating one of said different payouts when said randomly selected outcome is one of said plurality of winning outcomes, said method comprising the steps of:

randomly selecting one of said levels of winning outcomes as a selected bonus level for a game; and increasing said one of said different payouts activated by said randomly selected outcome of said game if said randomly selected outcome is a winning outcome and said randomly selected outcome is at said selected bonus level, wherein said gaming device is responsive to a monetary input of a single monetary unit and multiples of said single monetary unit and wherein said step of increasing said one of said different payouts is activated only if said monetary input is a maximum allowable multiple of said single monetary unit, and wherein said paytable comprises a non-bonus payout amount at each of said levels for each of said multiples of said monetary unit, including a maximum non-bonus payout for said maximum allowable multiple of said single monetary unit, and wherein said step of increasing said one of said different payouts comprises the steps of selecting one of said non-bonus payouts for said bonus level and adding it to said maximum non-bonus payout for said bonus level.

8. An electronic poker machine that plays an interactive game of poker with a player by dealing a first poker hand and displaying said hand to said player and permitting said player to selectively draw cards to replace cards in said first poker hand to generate a final poker hand, said machine comprising:

a first routine that randomly selects a selected level of poker hands as a selected bonus level, said first routine selecting a new selected bonus level for each game played by the player;

a second routine that compares said final poker hand to said level of poker hands to determine if said final poker hand is in said bonus level; and a third routine that increases a payout to said player if said final poker hand is in said bonus level.

* * * * *